United States Patent [19]

Kaldor

[11] Patent Number: 5,019,248

[45] Date of Patent: May 28, 1991

[54] APPARATUS FOR GRADING FIBROUS MATERIAL

[75] Inventor: Andrew F. Kaldor, Dover Heights, Australia

[73] Assignee: Ankal Pty Limited, Australia

[21] Appl. No.: 381,638

[22] PCT Filed: Nov. 11, 1987

[86] PCT No.: PCT/AU87/00378

§ 371 Date: Jul. 10, 1989

§ 102(e) Date: Jul. 10, 1989

[87] PCT Pub. No.: WO88/03444

PCT Pub. Date: May 19, 1988

[30] Foreign Application Priority Data

Nov. 14, 1986 [AU] Australia ..... PH8969

[51] Int. Cl.[5] ..... B07B 1/24; B07B 1/55

[52] U.S. Cl. ..... 209/240; 209/250; 209/254; 209/291; 209/297; 209/380; 209/407

[58] Field of Search ..... 209/44, 233, 235, 240, 209/241, 243, 247, 250, 254, 255, 257, 288–291, 293, 294, 296–298, 379, 380, 406, 407, 409, 411, 482; 241/74

[56] References Cited

U.S. PATENT DOCUMENTS

| | | | |
|---|---|---|---|
| 108,246 | 10/1870 | Fickinger | 209/235 X |
| 131,771 | 10/1872 | Moore | 209/411 |
| 725,642 | 4/1903 | Ash | 209/289 X |
| 735,663 | 8/1903 | Gent | 209/291 |
| 2,173,314 | 9/1939 | Rylander | 209/297 X |
| 2,518,598 | 8/1950 | Buck | 209/289 X |
| 3,620,369 | 11/1971 | Steen et al. | 209/247 X |
| 3,756,406 | 9/1973 | Khan | 209/291 |
| 3,786,870 | 1/1974 | List | 209/294 X |
| 4,043,901 | 8/1977 | Gauld | 209/294 X |
| 4,261,816 | 4/1981 | Beck et al. | 209/284 |
| 4,282,090 | 8/1981 | Hoernschemeyer et al. | 209/291 |
| 4,509,697 | 4/1985 | Riemann et al. | 209/297 X |

FOREIGN PATENT DOCUMENTS

| | | | |
|---|---|---|---|
| 293262 | 6/1966 | Australia . | |
| 0509304 | 4/1976 | U.S.S.R. | 209/291 |
| 615967 | 2/1947 | United Kingdom . | |
| 1015287 | 12/1965 | United Kingdom . | |
| 2122111 | 1/1984 | United Kingdom | 209/288 |

*Primary Examiner*—Michael S. Huppert
*Assistant Examiner*—Edward M. Wacyra
*Attorney, Agent, or Firm*—Hill, Van Santen, Steadman & Simpson

[57] ABSTRACT

An apparatus for separating different phases of dry material, such as plant fibers, from each other includes a rotating hollow body on an inclined axis with an inner perforated wall, an outer perforated wall, and partitions at spaced intervals within the body to define compartments. The compartments are connected by central openings in the partitions, and each compartment is provided with longitudinally extending baffles. The outer perforated wall is divided into longitudinal sections by a gap. The material is fed into an upper input end and the different phases are separated as it moves within the downwardly inclined body toward an outlet end. The separated phases are carried away by conveyors.

10 Claims, 3 Drawing Sheets

10
31
33
35
36
38
42
43
44
45
46
47
48
24
29
IV

APPARATUS FOR GRADING FIBROUS MATERIAL

This invention relates to apparatus for the separation of dry material into distinct phases, and more particularly for the separation of fibrous bark from core material of chopped or crushed stalks of a crop such as Kenaf.

BACKGROUND ART

In the case of the kenaf plant it is composed of stalk having a fibrous bark and core, of which the former possesses long fibres capable of producing a high quality paper pulp, while the latter is of lesser quality short fibre composition. In some areas of the world the process of recovering the bark fibre comprises cutting and bundling of the stalks, which are dried in the field and then retted with the bark fibre being scutched from the central woody stem. This is a time-consuming task and the bark fibre that is obtained is not in best form for paper pulping.

Proposals have been made for machine processing of the harvested stalks and this has entailed firstly crushing, grinding or chopping of the stalks, and subsequently separation of the bulk material into separate phases. A similar form of crushing mill to that utilised in the sugar cane industry has, in one instance, been utilised, although modified, for the first stage of processing, while in another instance a forage harvester has been used to gather the crop for baling in a finely chopped condition. It has not been possible to achieve high quality grading with conventional separation apparatus.

DISCLOSURE OF THE INVENTION

It is the main object of the invention to provide apparatus for grading fibrous material which is efficient and achieves a high degree of separation of the phases of the material.

In accordance with the invention there is provided apparatus for grading fibrous material comprising a hollow body for rotation on an inclined axis and having a perforated wall and upper inlet and lower outlet ends, an end plate at the inlet end of the body having an opening for the introduction of fibrous material for grading, a plurality of annular partitions within the body and spaced along its axis to define axially aligned compartments within the body, and a plurality of longitudinally extending, circumferentially spaced baffles within each of said compartments and extending between adjacent ones of said partitions, whereby with rotation of said body while downwardly inclined form said inlet to said outlet ends a fibrous phase of the material is conveyed by the baffles through a central opening in each of said annular partitions and via each of said compartments in turn to discharge from the outlet end, while a more solid phase is discharged through said perforated wall of the body.

BRIEF DESCRIPTION OF THE DRAWINGS

The invention will be described in more detail with reference to the accompanying drawings, in which.

Figure 1:
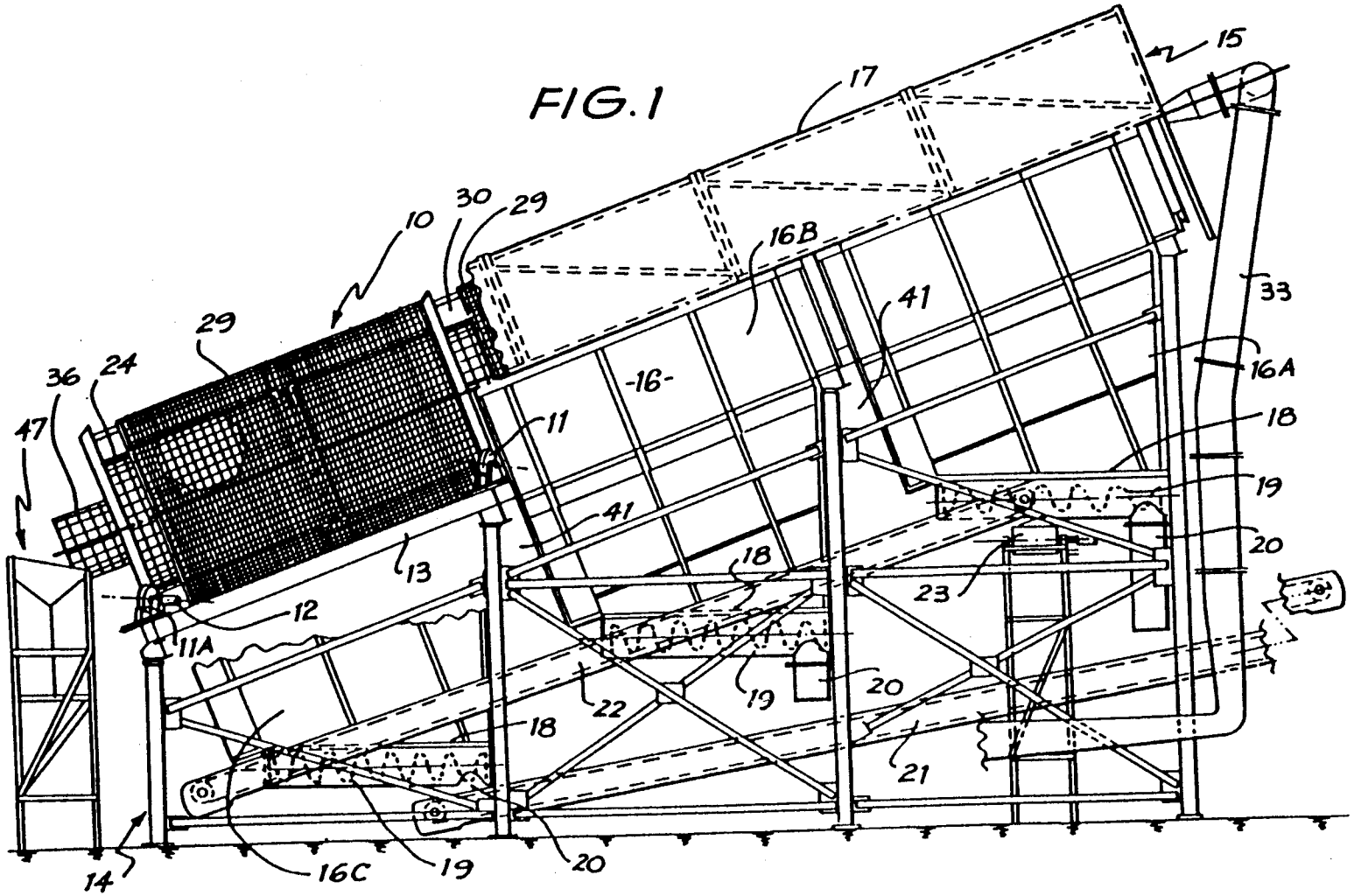
FIG. 1 is a side elevation, partly in broken section, of separation apparatus according to this invention.
Figures 2, 3:
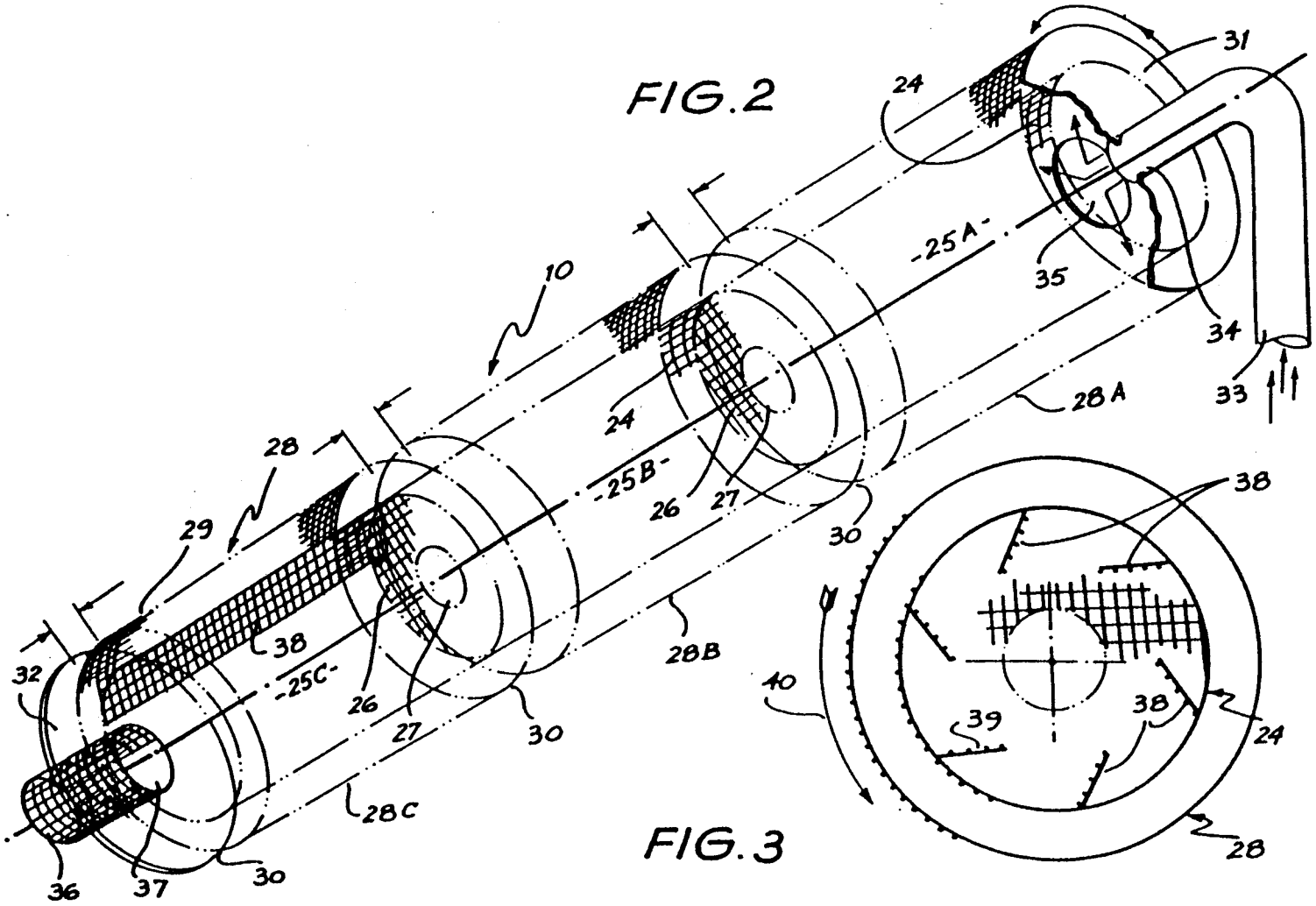
FIG. 2 is a diagrammatic representation in perspective of the internal construction of the apparatus.
FIG. 3 is a diagrammatic representation in end elevation thereof.

A preferred embodiment is shown in the drawings, and with reference to FIGS. 1 to 3 it will be seen that the separation apparatus of this invention consists of a hollow, cylindrical, perforated body 10 rotatable upon a series of support wheels 11 which wheel 11A is supplied with driving power via the shaft 12 in order to effect rotation of the body 10. Additional wheels 11 may also be supplied with driving power. The support wheels 11 are fixed upon an upper beam 13 carried by a frame 14 in such a way that the beam 13 is downwardly inclined from an input end 15 of the apparatus. Almost the entire body 10 is enclsed by a housing 16 preferably provided with a removable top cover 17. The main body of the housing 16 is divided into three separate longitudinally arranged sections 16A, 16B and 16C with the floor 18 of each section opening into a respective auger conveyor 19 which at its output end discharges through a chute 20 onto a belt conveyor 21 for gathering and disposal of a solid phase of material resulting from separation, as will be described hereafter. A second belt conveyor 22 collects material of a different phase, in a manner described hereafter, to deposit this phase upon a third conveyor 23 for its disposal.

The perforated body 10 consists of an inner cylinder 24 continuous throughout the length of the body 10 and includes a frame-supported cylindrical wall composed of steel mesh, say of a mesh gauge of 5cm×5cm. As represented in the drawings three separate compartments 25A, 25B and 25C are provided within the perforated cylinder 24 by spaced annular partitions 26 also formed of steel mesh of say 5cm×5cm gauge. Communication between compartments 25 is effected through the central openings 27 in the partition walls 26. The perforated cylinder 24 is enclosed by an outer cylinder 28 comprising a wall 29 of steel mesh of a gauge of say 2.5cm×2.5cm. Intermediate gaps 30 are provided in the wall 29 whereby the cylinder 28 is in three lingitudinal sections 28A, 28B and 28C. Imperforate, annular plates 31 and 32 enclose the opposite ends of both the perforate cylinders 24 and 28. Bulk material input, under air pressure may be applied via ducting 33 through the central opening 34 in the end plate 31 to impinge upon an internal deflector plate 35 from where it is outwardly deflected onto the perforated wall of the cylinder 24. A discharge duct 36, which is preferably imperforate, although shown otherwise, is secured to the central opening 37 in the discharge end plate 32. It is envisaged that two, or even more, similar outer cylinders, concentric with each other and of different diameters, may be incorporated to enhance separation in some instances.

Within the perforate cylinder 24 are fixed, flat, rectangular baffles 38, comprising steel mesh of say 5cm×5cm gauge, spaced circumferentially and internally around each of the compartments 25A, 25B and 25C, and extending between partitions 26 and, therefore, the full length of each compartment 25. The disposition of the baffles 38 within any compartment 25 is more clearly represented in FIG. 3, where six baffles 38 are shown secured along one of their sides to the interior of the perforate cylinder 24 with the broad face 39 of each forwardly inclined from a radial alignment with the axis of the body 10, as viewed in respect of the direction if its rotation as indicated by the arrow 40. It will be noted from FIG. 1 that the gaps 30 in the outer perforate wall 29 correspond to gaps 41 in the housing 16, and that these gaps 41 overlie the conveyor 22.

When a bulk of crop, such as Kenaf, which has been pulverised, crushed, or chopped, is to be supplied to the apparatus for separation into separate phases, it will be preferably transported to the site in the form of bales 42 which are then advanced upon a conveyor 43 to bale-breaking apparatus 44, which via rotating shredders 45 discharge a continuous stream of bulk crop into the ducting 33 which is blown by a motorised fan 46 into the entry to the rotatable body 10. In one instance the body 10 has been inclined at a downward angle of about 20 degrees and caused to rotate about its axis at a speed of 24 revolutions per minute. Although, the inclination of 20 degrees is preferred rotation speeds of from 10 to 35 revolutions per minute could be employed. As a result the baffles 38 impart a tumbling action to the bulk material within the first compartment 25A. Due to the forward inclination of the baffles 38 the material is carried to its maximum height before being allowed to fall under gravity during rotation of the cyclinders 24 and 28. In one instance the inclination of the baffles 38 is approximately 35 degrees, but this is not a strict requirement. The bulk material of Kenaf in this compartment 25A is generally composed of three phases, firstly a mixture of relatively fine particles of core material and fibrous bark material, as well as a relatively small quantity of large chunks of core material. The larger particles will readily separate from the bark fibre and pass through the mesh of the inner perforate cylinder 24 from where it will travel down the inside of the outer cylinder 28 to be discharged at the first gap 30 to fall through an opening 41 between the sections of the housing 16 onto the conveyor 22. Further separation occurs in succeeding compartments 25B and 25C for discharge of large core particles at other positions onto the conveyor 22. As this phase of the bulk material is undesirable for pulping, it may be returned to the bale breaker 44 via the conveyor 23, or to other pulverising machinery, for subsequent re-input to the separation apparatus.

Due to the elevation via the baffles 38 within the inner cylinder 24 of the bark fibre admixed with fine particles of core material separation of these two phase principally occurs during falling of the admixture under gravity. The small core particles pass through the mesh of both the inner and outer cylinders 24 and 28 and is gathered within the respective sections of the housing 16 for supply to the conveyor 21. The output from this conveyor 21 is, therefore, pure relatively fine particles of Kenaf core material suitable for paper pulping.

Due to the inclination of the body 10 the bark fibre is advanced from compartment to compartment by dropping from a baffle 38 through the central opening 27 of any partition 26 until it is discharged from the outlet duct 36 as pure, high quality fibre. The more compartments 25 provided in the body 10 the greater purity of the recovered fibre, but it has been found that three-stage separation, as shown in the drawings, is effective to obtain acceptable quality of phases without over complication of structure. Any suitable conveyor or storage hopper 47 may be utilised for collection of the discharged bark fibre phase.

Figures 4, 5:
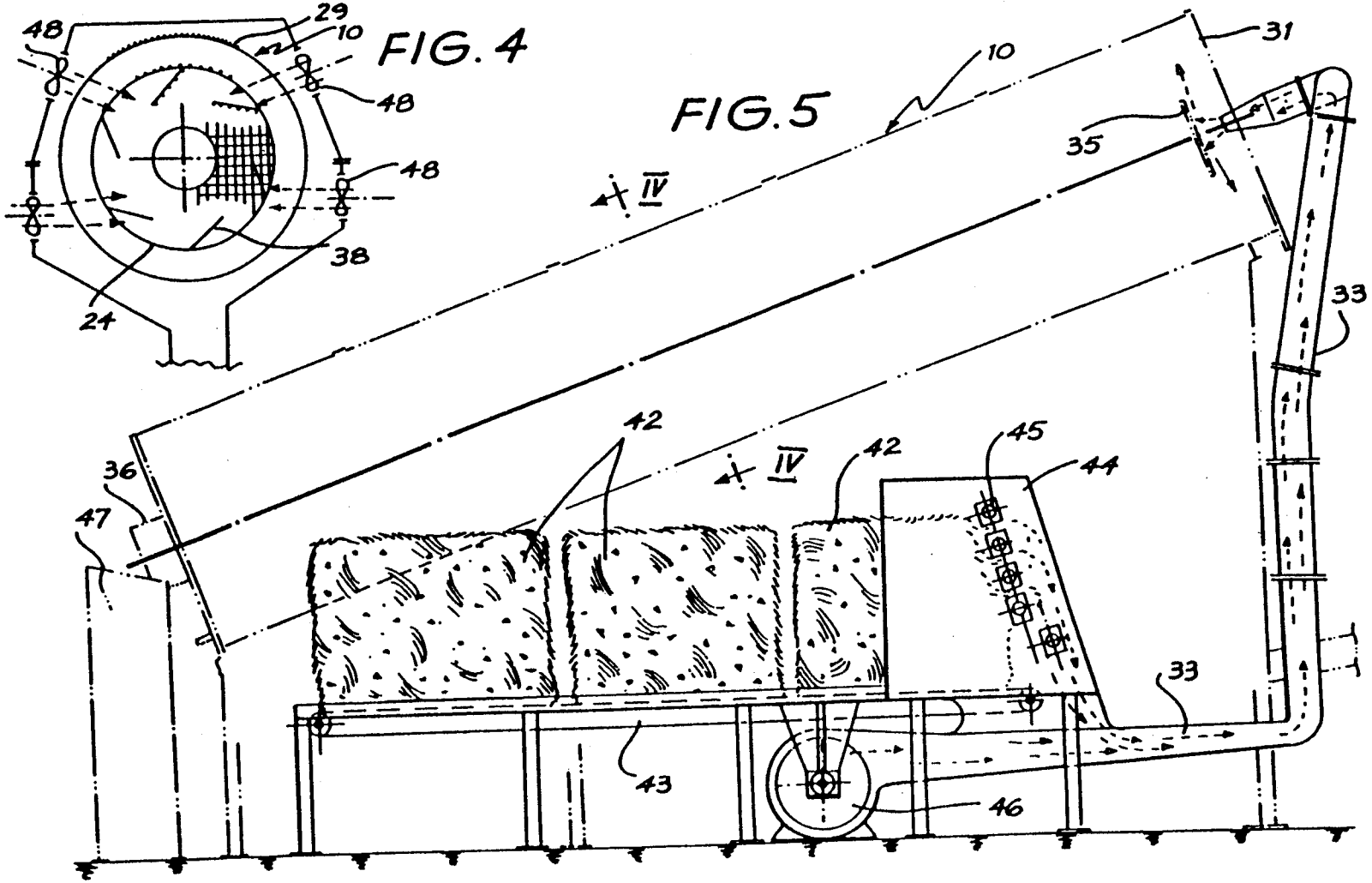
FIG. 4 is a diagrammatic transverse section on the line IV—IV of FIG. 5.
FIG. 5 is a side elevation of an installation showing bulk input being applied to the separation apparatus from a bale breaking machine.

In some instances choking of the space between the cylinders 24 and 29 may occur, and to prevent this, and also to assist in separation of the two principal phases, fans 48 may be provided in the housing 16 to direct air substantially radially through the cylinder 28, as shown in FIG. 4.

A preferred embodiment has been described in the foregoing passages and it should be understood that other forms, modifications and refinements are feasible within the scope of this invention.

I claim:

1. An apparatus for grading fibrous material into a fibrous phase and a more solid phase, comprising:

a hollow body for rotation on an inclined axis having an inner perforated wall and upper inlet and lower outlet ends, an end plate at the inlet end of the body having an opening for the introduction of fibrous material for grading, a plurality of unobstructed annular partitions within the body and spaced along its axis to define axially aligned compartments within the body, a plurality of longitudinally extending, circumferentially spaced mesh baffles within each of said compartments and extending between adjacent ones of said partitions, and an outer perforated wall surrounding said inner perforated wall and rotatable therewith and being divided into longitudinal sections by at least one gap, whereby with rotation of said body while downwardly inclined from said inlet to said outlet ends fibrous phase of the material is conveyed by the baffles through a central opening in each of said annular partitions and via each of said compartments in turn to discharge from the outlet end, while a more solid phase is discharged through said inner perforated wall of the body and then through said outer perforated wall and/or said at least one gap therein.

2. An apparatus according to claim 1, wherein said inner and outer perforated walls of the hollow body are composed of metal mesh.

3. An apparatus according to claim 2, wherein the gauge of the metal mesh of said outer perforated wall is finer than the gauge of said inner perforated wall.

4. An apparatus as claimed in claim 2, wherein the metal mesh is of uniform mesh gage.

5. An apparatus according to claim 1, wherein each of said partitions and each of said baffles comprises metal mesh.

6. An apparatus according to claim 5, wherein the metal mesh is of uniform mesh gauge.

7. An apparatus according to claim 1, wherein each of said baffles is of substantially flat rectangular form and is disposed in a plane which is forwardly inclined, in respect of the direction of rotation of said hollow body, from radial alignment therewith.

8. An apparatus according to claim 1, further comprising framework supporting at an inclined angle said hollow body and, means for rotating said hollow body and upon said framework and a housing of the framework enclosing said hollow body and, and conveyor means for collecting and tranporting from said housing said more solid phase of the material.

9. An apparatus according to claim 8, futher comprising means carried by said housing for directing an air stream inwardly through said outer perforated wall and into said hollow body.

10. An apparatus according to claim 1, further comprising deflector means positioned within said hollow body to deflect the fibrous material being introduced outwardly towards said inner perforated wall.

* * * * *